US009440119B2

(12) United States Patent
Sullivan et al.

(10) Patent No.: US 9,440,119 B2
(45) **Date of Patent: *Sep. 13, 2016**

(54) GOLF BALL HAVING SPECIFIC SPIN, MOMENT OF INERTIA, LIFT, AND DRAG RELATIONSHIP

(71) Applicant: Acushnet Company, Fairhaven, MA (US)

(72) Inventors: Michael J. Sullivan, Old Lyme, CT (US); Derek A. Ladd, Acushnet, MA (US); Edmund A. Hebert, Mattapoisett, MA (US); Laurent Bissonnette, Portsmouth, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/539,198

(22) Filed: Nov. 12, 2014

(65) Prior Publication Data

US 2015/0148150 A1 May 28, 2015

Related U.S. Application Data

(63) Continuation of application No. 13/939,574, filed on Jul. 11, 2013, now Pat. No. 8,956,249, which is a continuation of application No. 11/333,358, filed on Jan. 18, 2006, now Pat. No. 8,617,003.

(51) Int. Cl.
*A63B 37/06* (2006.01)
*A63B 37/00* (2006.01)

(52) U.S. Cl.
CPC ..... *A63B 37/0077* (2013.01); *A63B 37/0003* (2013.01); *A63B 37/009* (2013.01); *A63B 37/0015* (2013.01); *A63B 37/0031* (2013.01); *A63B 37/0043* (2013.01);
(Continued)

(58) Field of Classification Search
CPC ..... A63B 37/0089; A63B 37/009
USPC ..... 473/351, 378, 383
See application file for complete search history.

(56) References Cited

U.S. PATENT DOCUMENTS

| | | | | |
|---|---|---|---|---|
| 3,262,272 | A | 7/1966 | Barakauskas et al. | 60/39.05 |
| 3,264,272 | A | 8/1966 | Rees | 260/78.5 |

(Continued)

FOREIGN PATENT DOCUMENTS

| | | |
|---|---|---|
| JP | 2001-514058 | 9/2001 |
| JP | 2002-224242 | 8/2002 |

(Continued)

OTHER PUBLICATIONS

Non-Final Office Action dated Apr. 23, 2010 of corresponding U.S. Appl. No. 11/333,358.

(Continued)

*Primary Examiner* — Raeann Gorden
(74) *Attorney, Agent, or Firm* — Smith, Gambrell & Russell, LLP

(57) ABSTRACT

Golf ball with a novel combination of spin rate, lift coefficient, drag coefficients, and optionally moment of inertia: a golf ball with a low spin rate, a high lift coefficient, a low drag coefficient, and optionally a high moment of inertia; and a golf ball with a high spin rate, a low lift coefficient, a low drag coefficient, and optionally a low moment of inertia.

20 Claims, 8 Drawing Sheets

(52) U.S. Cl.
CPC ..... *A63B 37/0051* (2013.01); *A63B 37/0062* (2013.01); *A63B 37/0065* (2013.01); *A63B 37/0075* (2013.01); *A63B 37/0078* (2013.01); *A63B 37/0089* (2013.01); *A63B 37/0096* (2013.01); *A63B 37/0005* (2013.01); *A63B 37/0006* (2013.01); *A63B 37/0021* (2013.01)

(56) References Cited

U.S. PATENT DOCUMENTS

| | | | | |
|---|---|---|---|---|
| 3,819,768 | A | 6/1974 | Molitor | 260/397 B |
| 4,264,075 | A | 4/1981 | Miller et al. | 273/235 R |
| 4,526,375 | A | 7/1985 | Nakade | 273/235 R |
| 4,911,451 | A | 3/1990 | Sullivan et al. | 273/235 R |
| 4,925,193 | A | 5/1990 | Melvin et al. | 273/232 |
| 5,000,549 | A | 3/1991 | Yamazaki | 350/423 |
| 5,068,151 | A | 11/1991 | Nakamura | 428/407 |
| 5,120,791 | A | 6/1992 | Sullivan | 525/196 |
| 5,197,740 | A | 3/1993 | Pocklington et al. | 273/235 R |
| 5,249,804 | A | 10/1993 | Sanchez | 273/232 |
| 5,298,571 | A | 3/1994 | Statz et al. | 525/330.2 |
| 5,562,552 | A | 10/1996 | Thurman | 473/379 |
| 5,566,943 | A | 10/1996 | Boehm | 473/385 |
| 5,575,477 | A | 11/1996 | Hwang | 473/379 |
| 5,682,230 | A | 10/1997 | Anfinsen et al. | 356/28 |
| 5,824,746 | A | 10/1998 | Harris et al. | 525/196 |
| 5,836,832 | A | 11/1998 | Boehm et al. | 473/354 |
| 5,846,141 | A | 12/1998 | Morgan et al. | 473/377 |
| 5,919,100 | A | 7/1999 | Boehm et al. | 473/354 |
| 5,935,023 | A | 8/1999 | Maehara et al. | 473/384 |
| 5,957,787 | A | 9/1999 | Hwang | 473/379 |
| 6,025,442 | A | 2/2000 | Harris et al. | 525/221 |
| 6,117,025 | A | 9/2000 | Sullivan | 473/373 |
| 6,149,535 | A | 11/2000 | Bissonnette et al. | 473/354 |
| 6,152,834 | A | 11/2000 | Sullivan | 473/365 |
| 6,186,002 | B1 | 2/2001 | Lieberman et al. | 73/432.1 |
| 6,213,892 | B1 | 4/2001 | Felker et al. | 473/370 |
| 6,213,898 | B1 | 4/2001 | Ogg | 473/383 |
| 6,285,445 | B1 | 9/2001 | Winfield et al. | 356/28 |
| 6,290,615 | B1 | 9/2001 | Ogg | 473/378 |
| 6,299,552 | B1 | 10/2001 | Morgan et al. | 473/384 |
| 6,338,684 | B1 | 1/2002 | Winfield et al. | 473/378 |
| 6,358,161 | B1 | 3/2002 | Aoyama | 473/383 |
| 6,394,913 | B1 | 5/2002 | Nesbitt et al. | 473/371 |
| 6,482,110 | B2 | 11/2002 | Ogg | 473/383 |
| 6,494,795 | B2 | 12/2002 | Sullivan | 473/372 |
| 6,729,976 | B2 | 5/2004 | Bissonnette et al. | 473/383 |
| 6,796,912 | B2 | 9/2004 | Dalton et al. | 473/383 |
| 6,902,402 | B2 | 6/2005 | McClintic | 434/30 |
| 6,902,498 | B2 | 6/2005 | Sullivan et al. | 473/374 |
| 6,908,402 | B2 | 6/2005 | Sullivan et al. | 473/376 |
| 8,512,166 | B2 * | 8/2013 | Sullivan et al. | 473/378 |
| 2005/0059510 | A1 | 3/2005 | Sullivan et al. | 473/371 |

FOREIGN PATENT DOCUMENTS

| | | |
|---|---|---|
| JP | 2002-331047 | 11/2002 |
| JP | 2003-000763 | 1/2003 |
| JP | 2003-521283 | 7/2003 |
| JP | 2003-296655 | 10/2003 |
| JP | 2005-296655 | 10/2005 |

OTHER PUBLICATIONS

Final Office Action dated Oct. 14, 2010 of corresponding U.S. Appl. No. 11/333,358.

Non-Final Office Action dated Aug. 2, 2011 of corresponding U.S. Appl. No. 11/333,358.

Final Office Action dated Dec. 1, 2011 of corresponding U.S. Appl. No. 11/333,358.

Advisory Action dated Mar. 6, 2012 of corresponding U.S. Appl. No. 11/333,358.

Japanese Office Action dated Jan. 10, 2013 of corresponding Japanese Patent Application No. 2007-8876.

Japanese Office Action dated May 7, 2012 of corresponding Japanese Patent Application No. 2007-8876.

Japanese Office Action dated Apr. 4, 2011 of corresponding Japanese Patent Application No. 2007-8876.

Japanese Office Action dated Mar. 8, 2010 of corresponding Japanese Patent Application No. 2007-8876.

Chinese Office Action Feb. 21, 2010 dated Jan. 10, 2013 of corresponding Japanese Patent Application No. 200710001862.6.

Chinese Office Action Apr. 25, 2009 dated Jan. 10, 2013 of corresponding Japanese Patent Application No. 200710001862.6.

Non-Final Office Action dated Oct. 8, 2013 of corresponding U.S. Appl. No. 13/939,574.

Final Office Action dated Jun. 2, 2014 of corresponding U.S. Appl. No. 13/939,574.

Non-Final Office Action dated Oct. 3, 2007 of corresponding U.S. Appl. No. 11/333,358.

Final Office Action dated Jul. 11, 2008 of corresponding U.S. Appl. No. 11/333,358.

Advisory Action dated Nov. 10, 2008 of corresponding U.S. Appl. No. 11/333,358.

Advisory Action dated Dec. 4, 2008 of corresponding U.S. Appl. No. 11/333,358.

Non-Final Office Action dated Mar. 19, 2009 of corresponding U.S. Appl. No. 11/333,358.

Final Office Action dated Dec. 9, 2009 of corresponding U.S. Appl. No. 11/333,358.

Advisory Action dated Mar. 22, 2010 of corresponding U.S. Appl. No. 11/333,358.

* cited by examiner $D_A < D_B \leq D_C \leq D_D \leq D_E$
80% $D_A$, $D_B$, $D_C$, $D_D$, $D_E$ > 0.11"
DIMP. AREA > 80%

$D_A < D_B \leq D_C \leq D_D \leq D_E$

GOLF BALL HAVING SPECIFIC SPIN, MOMENT OF INERTIA, LIFT, AND DRAG RELATIONSHIP

CROSS-REFERENCE TO RELATED APPLICATIONS

This application is a continuation of U.S. application Ser. No. 13/939,574, filed Jul. 11, 2013, now pending, which is a continuation of U.S. patent application Ser. No. 11/333,358, filed Jan. 18, 2006, now U.S. Pat. No. 8,617,003, the entire disclosures of which are incorporated by reference herein.

FIELD OF THE INVENTION

The present invention relates to a golf ball having a unique relationship between various aerodynamic properties. In particular, the golf ball of the present invention has a specific relationship between ball spin rate, moment of inertia, lift, and drag.

BACKGROUND OF THE INVENTION

The spin rate of golf balls is the end result of many variables, one of which is the distribution of the density or specific gravity within the ball. Spin rate is an important characteristic of golf balls for both skilled and recreational golfers. High spin rate allows the more skilled players, such as PGA professionals and low handicapped players, to maximize control of the golf ball. A high spin rate golf ball is advantageous for an approach shot to the green. The ability to produce and control back spin to stop the ball on the green and side spin to draw or fade the ball substantially improves the player's control over the ball. Hence, the more skilled players generally prefer a golf ball that exhibits high spin rate.

On the other hand, recreational players who cannot intentionally control the spin of the ball generally do not prefer a high spin rate golf ball. For these players, slicing and hooking are the more immediate obstacles. When a club head strikes a ball, an unintentional side spin is often imparted to the ball, which sends the ball off its intended course. The side spin reduces the player's control over the ball, as well as the distance the ball will travel. A golf ball that spins less tends not to drift off-line erratically if the shot is not hit squarely off the club face. The low spin ball will not cure the hook or the slice, but will reduce the adverse effects of the side spin. Hence, recreational players prefer a golf ball that exhibits low spin rate.

Aerodynamic forces acting on a golf ball are typically resolved into orthogonal components of lift and drag. Lift is defined as the aerodynamic force component acting perpendicular to the flight path. It results from a difference in pressure that is created by a distortion in the air flow that results from the back spin of the ball. A boundary layer forms at the stagnation point of the ball, B, then grows and separates at points S1 and S2, as shown in FIG. 1. Due to the ball backspin, the top of the ball moves in the direction of the airflow, which retards the separation of the boundary layer. In contrast, the bottom of the ball moves against the direction of airflow, thus advancing the separation of the boundary layer at the bottom of the ball. Therefore, the position of separation of the boundary layer at the top of the ball, S1, is further back than the position of separation of the boundary layer at the bottom of the ball, S2. This asymmetrical separation creates an arch in the flow pattern, requiring the air over the top of the ball to move faster and, thus, have lower pressure than the air underneath the ball.

Drag is defined as the aerodynamic force component acting parallel to the ball flight direction. As the ball travels through the air, the air surrounding the ball has different velocities and, accordingly, different pressures. The air exerts maximum pressure at the stagnation point, B, on the front of the ball, as shown in FIG. 1. The air then flows over the sides of the ball and has increased velocity and reduced pressure. The air separates from the surface of the ball at points S1 and S2, leaving a large turbulent flow area with low pressure, i.e., the wake. The difference between the high pressure in front of the ball and the low pressure behind the ball reduces the ball speed and acts as the primary source of drag for a golf ball.

An average professional can generally drive a golf ball at a speed of approximately 235 feet per second (ft/s) or 160 miles per hour (mph). Most amateur golfers, however, have a "lower swing-speed," i.e., slower club head speed at impact compared to a professional golfer, and are able to drive the ball at a speed of about 130 mph and a distance of less than about 200 to about 240 yards. When compared to a ball hit by a high swing-speed player, a similar ball that is hit by a low swing-speed player travels along a more ballistic trajectory than the trajectory typically achieved by tour caliber players.

For example, when a player strikes a ball, a portion of the energy from the club head is transferred to the ball as ball speed, and another portion of the energy is transferred to the ball as ball spin. Players with low swing-speed will have less energy available to transfer to both ball speed and ball spin. When club speed becomes very low, the resulting ball speed can be low enough that the effect of ball spin does not significantly increase lift ($F_L$), which, in turn, generates a low ball speed (V) and low lift ($F_L$). Thus, the advantages of a golf ball designed to have beneficial flight properties, such as high spin and high lift, are minimized when hit by a low swing-speed player.

Low weight golf balls have been made in an attempt to increase the lift to weight ratio of the golf ball, thereby increasing the effects of the lift on ball trajectory, and also to produce a greater initial velocity upon impact than a heavier ball. It is generally known that low weight golf balls slow down faster than normal weight golf balls due to drag, an effect that is magnified at higher speeds. As a result, these low weight balls have not been effectively designed to decrease the effect of drag. Several attempts have been made in the past to minimize drag, but these attempts have been focused only in combination with a player having a higher swing-speed.

The dimples on a golf ball are used to adjust drag and lift properties of a golf ball and, therefore, the majority of golf ball manufacturers research dimple patterns, shape, volume, and cross-section in order to improve overall flight distance of a golf ball. The dimples create a thin turbulent boundary layer around the ball. The turbulence energizes the boundary layer and aids in maintaining attachment to and around the ball to reduce the area of the wake. The pressure behind the ball is increased and the drag is substantially reduced.

A high degree of dimple coverage is beneficial to flight distance, but only if the dimples are of a reasonable size. Dimple coverage gained by filling spaces with tiny dimples is not very effective, since tiny dimples are not good turbulence generators. Most balls today still have many large spaces between dimples or have filled in these spaces with very small dimples that do not create enough turbulence at average golf ball velocities. Generally, as the lift of a dimple pattern increases, drag also increases. Conventional dimple designs tend to be aerodynamically optimized for higher swing speeds than low swing-speed players can achieve.

The construction of the golf ball may also play an important role in the optimization of the flight characteristics of a golf ball. Over the past decade, advances in core and cover chemistry and layer construction have led to golf balls with improved in-play characteristics, such as initial velocity, spin rate and feel. Golf balls are typically constructed of a single or multilayer core, solid or wound, that is tightly surrounded by a single or multilayer cover formed of polymeric materials, e.g., polyurethane, balata rubber, ionomers, or a combination thereof. Golf balls with a low modulus thermoset polyurethane cover, for example, have inherent high spin rates, high drag levels, and manufacturing difficulties.

While past research has been focused on either on the optimization of golf ball aerodynamic properties or golf ball construction to make slight improvements in flight characteristics, most advances have benefited high swing speed players. In addition, most long distance prior art golf balls possess low spin at high launch angles and low lift coefficients, while most short distance prior art golf balls possess high spin at low launch angles and high lift coefficients. Both types of golf balls typically have high drag coefficients.

There is minimal prior art disclosing preferred aerodynamic characteristics for golf balls. U.S. Pat. No. 5,935,023 discloses preferred lift and drag coefficients for a single speed with a functional dependence on spin ratio. U.S. Pat. Nos. 6,213,898 and 6,290,615 disclose golf ball dimple patterns that reduce high-speed drag and increase low speed lift. It has now been discovered, contrary to the disclosures of these patents, that reduced high-speed drag and increased low speed lift does not necessarily result in improved flight performance.

For example, excessive high-speed lift or excessive low-speed drag may result in undesirable flight performance characteristics. The prior art is largely silent, however, as to the combination of several aerodynamic features that influence other portions of golf ball flight, such as moment of inertia and flight consistency, as well as enhanced aerodynamic lift and drag coefficients for balls of varying size and weight.

A need thus exists for optimization of golf ball flight characteristics for all types of golfer swing speed, ability, or technique. In particular, a need exists in the art for a golf ball having a unique combination of lift and drag coefficients and spin rates.

SUMMARY OF THE INVENTION

The present invention is directed to a golf ball including a core and cover, wherein the golf ball comprises a moment of inertia of about 0.46 oz/in$^2$ or greater, the lift coefficient is greater than about 0.20, the drag coefficient is less than about 0.22 at a Reynolds Number of about 145000. In one embodiment, the core has a compression of about 90 or less. In another embodiment, the core has a compression of about 70 or less.

The cover may have a hardness of about 60 Shore D or greater. In one embodiment, the cover has a hardness of about 65 Shore D or greater. In yet another embodiment, the cover includes an inner cover layer and an outer cover layer. In this aspect of the invention, the inner cover layer may have a first hardness and the outer cover layer has a second hardness less than the first hardness. For example, in one embodiment, the first hardness may be about 60 Shore D or greater and the second hardness may be less than about 60 Shore D. Conversely, the inner cover layer may have a first hardness and the outer cover layer has a second hardness greater than the first hardness. For instance, the first hardness may be less than about 60 Shore D or greater and the second hardness may be about 60 Shore D or greater.

The present invention is also directed to a golf ball including a core and cover, wherein the golf ball comprises a moment of inertia of about 0.40 oz/in$^2$ or less, the lift coefficient is less than about 0.20, and the drag coefficient is less than about 0.22 at a Reynolds Number of about 145000. In one embodiment, the core has a compression of about 70 or greater. In another embodiment, the core has a compression of about 80 or greater. In yet another embodiment, the cover has a hardness of about 60 or less, preferably about 55 or less.

In this aspect of the invention, the cover may include an inner cover layer and an outer cover layer. In one embodiment, the inner cover layer has a first hardness and the outer cover layer has a second hardness greater than the first hardness. For example, the first hardness is less than about 60 Shore D or greater and the second hardness is about 60 Shore D or greater. In another embodiment, the inner cover layer has a first hardness and the outer cover layer has a second hardness less than the first hardness. For instance, the first hardness is about 60 Shore D or greater and the second hardness is less than about 60 Shore D.

BRIEF DESCRIPTION OF THE DRAWINGS

These and other aspects of the present invention may be more fully understood with reference to, but not limited by, the following drawings.

DETAILED DESCRIPTION OF THE INVENTION

The present invention is directed to golf balls having novel combinations of spin rates and lift and drag coefficients. In particular, the present invention is directed to a golf ball having a unique relationship between spin rate, lift and drag coefficients, and moment of inertia. The golf balls of the invention may be used with a variety of golfer swing speeds, abilities, and techniques.

Prior art golf balls at low spin rates and high launch angles typically have low lift coefficients and low drag coefficients coupled with a high moment of inertia. This combination of aerodynamic properties is beneficial for players desiring a long distance shot off the tee, but a player will have little control over the flight of the ball.

Figure 1:
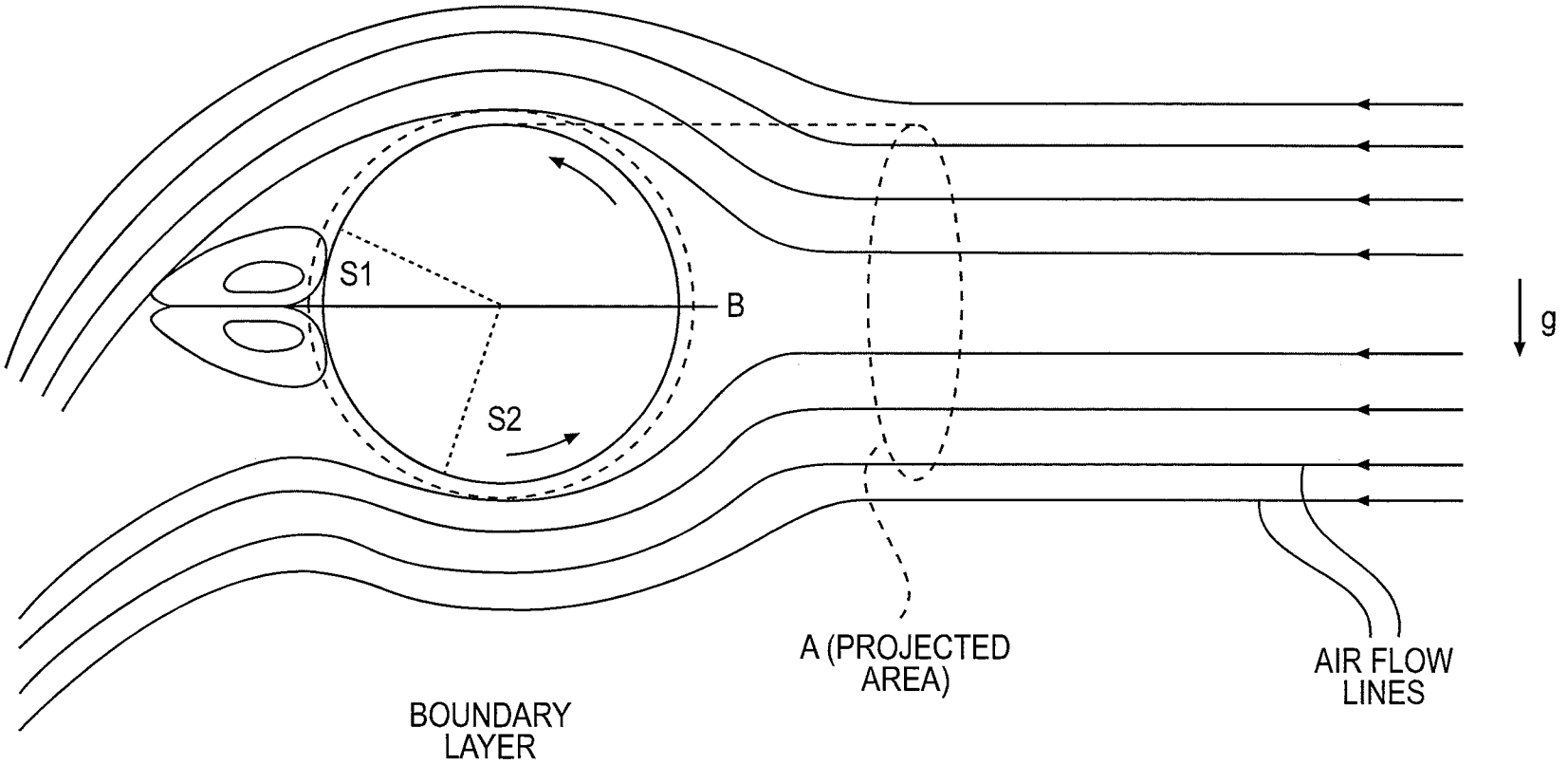
FIG. 1 is an illustration of the air flow on a golf ball in flight.
Figure 2:
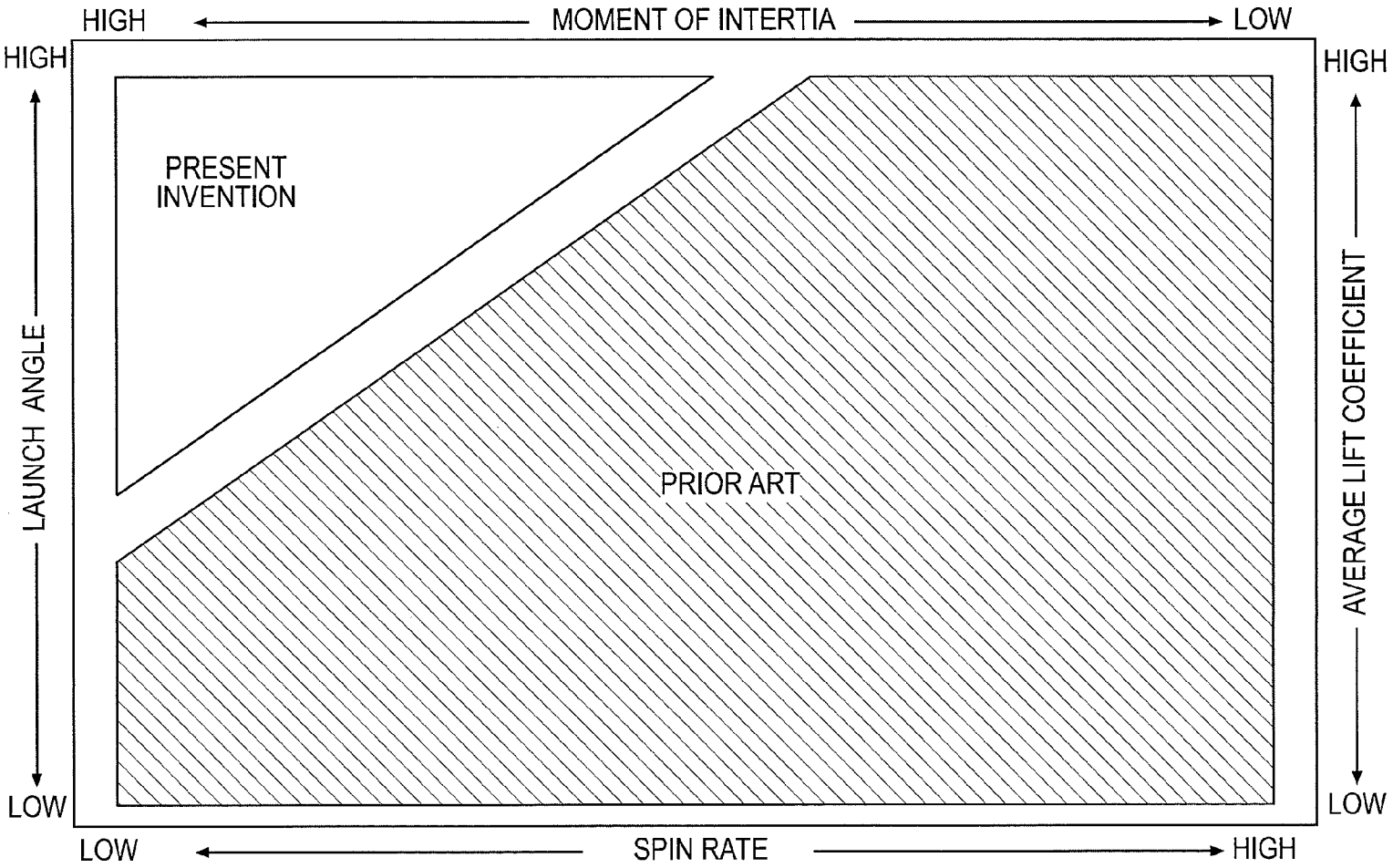
FIG. 2 PRIOR ART
FIG. 2 is a graph showing aerodynamic properties of the golf balls of the present invention according to one embodiment.

The first embodiment of the present invention is directed to a golf ball with low spin rates, high lift coefficients, and low drag coefficients, as illustrated in FIG. 2. A high coefficient of lift according to this embodiment corresponds to a variety of swing speeds and a variety of Reynolds Numbers and spin rates. As used herein, "low spin rates" refers to initial driver spin rates of about 3100 rpm or less at a launch angle of greater than about 10 degrees. The spin rate of the golf ball may be measured using a variety of methods, of which one of ordinary skill in the art is aware. For example, spin rate may be measured by observing the rotation of the ball in flight using stop action Strobe photography. The spin rate is a function of club-head speed, launch angle, and initial velocity and may thus be controlled by adjusting these parameters. The moment of inertia of a golf ball may also help to control the spin rate of a golf ball. For example, as discussed in more detail below, a high moment of inertia may help to attain a low golf ball spin rate.

In this aspect of the invention, a high lift and low drag is coupled with low to medium swing speed and low spin. For example, the lift coefficient ($C_L$) is greater than about 0.20 and the drag coefficient ($C_D$) is less than about 0.22 at a low to medium swing speed, e.g., Reynolds Numbers ($N_{Re}$) of about 145000 and a low spin rate (ω) of about 3100 rpm.

Preferably, a golf ball according to this embodiment also possesses a high moment of inertia, which may aid in facilitating the design of a golf ball having less spin. For example, in one embodiment, a low spin rate golf ball preferably has a moment of inertia of about 0.46 oz/in$^2$ or greater. In one embodiment, the moment of inertia is about 0.48 oz/in$^2$ or greater. In yet another embodiment, the moment of inertia is about 0.49 oz/in$^2$or greater. Table 1 shows general aerodynamic characteristics for a low spin golf ball having high lift and low drag according to this embodiment of the invention.

TABLE 1

Aerodynamic Characteristics For Low Spin Golf Ball

| $N_{Re}$ | ω (rpm) | $C_L$ | $C_D$ | Moment of Inertia |
|---|---|---|---|---|
| 145000 | 3100 | >0.20 | <0.22 | >0.46 oz/in$^2$ |

Prior art golf balls having conventional dimple patterns at high spin rates and low launch angles typically have high lift coefficients and high drag coefficients coupled with a low moment of inertia. This combination of aerodynamic properties forces the golf ball to leave the club head vertically in a high head wind resulting in low distance, which may be useful for play in and around the green.

Figure 3:
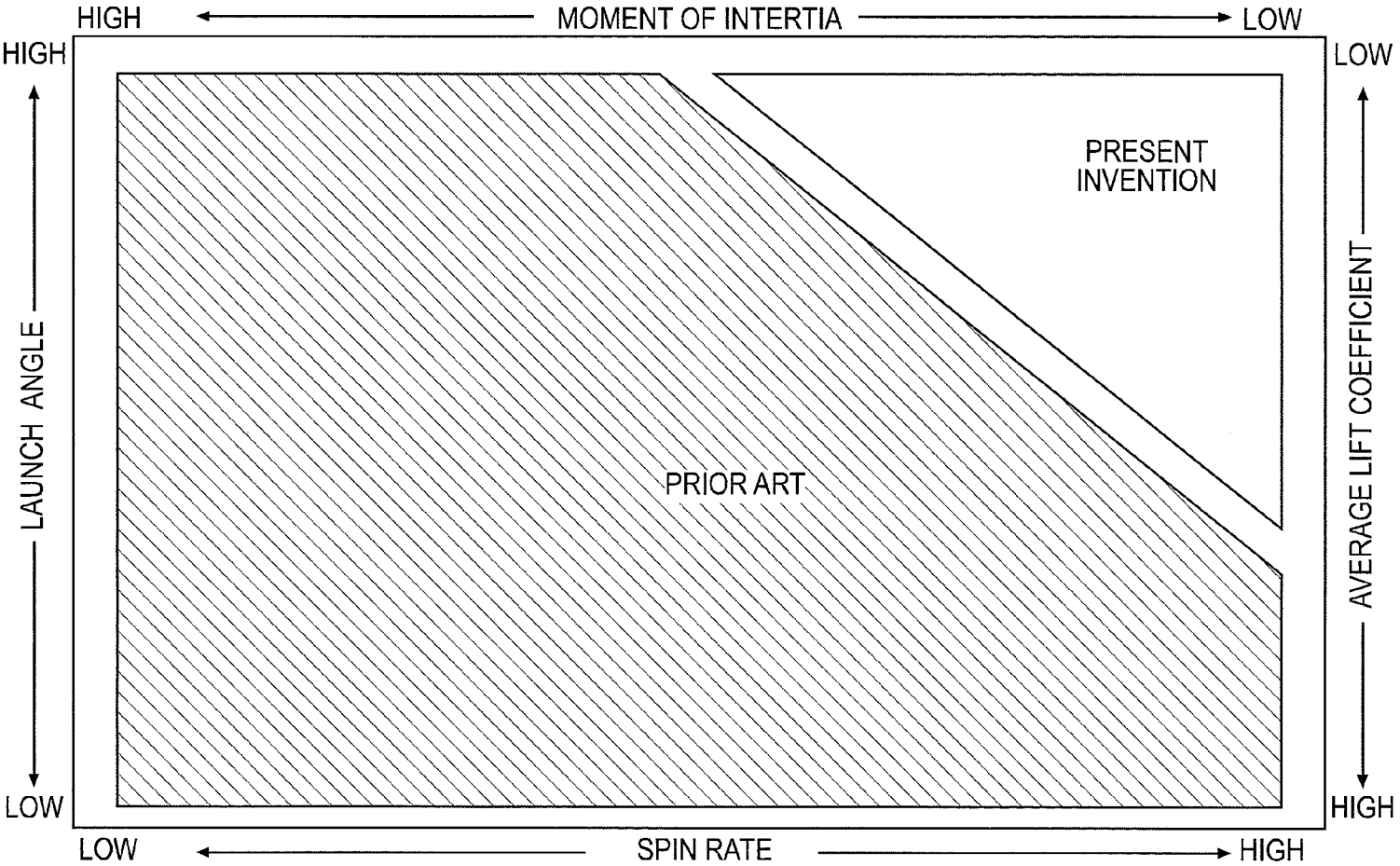
FIG. 3 PRIOR ART
FIG. 3 is a graph showing aerodynamic properties of the golf balls of the present invention according to another embodiment.

The second embodiment of the present invention is directed to lower the trajectory of a golf ball with a high spin rate in contrast to the above-referenced prior art golf balls. This may be accomplished by designing a golf ball with a high spin rate, a low lift coefficient, and a low drag coefficient, as illustrated in FIG. 3. A low coefficient of lift according to this embodiment corresponds to a variety of swing speeds and a variety of Reynolds Numbers and spin rates. For example, the lift coefficient ($C_L$) is less than about 0.20 and the drag coefficient ($C_D$) is less than about 0.22 at a low to medium swing speed, e.g., Reynolds Numbers ($N_{Re}$) of about 145000 and a high spin rate (ω) of about 3700 rpm at a ball speed of 120 m/h.

Preferably, a golf ball according to this embodiment also possesses a low moment of inertia, which may aid in facilitating the design of a golf ball having these aerodynamic properties. For example, in one embodiment, a high spin rate golf ball preferably has a moment of inertia of about 0.4 oz/in$^2$ or less. In another embodiment, the moment of inertia is about 0.38 oz/in$^2$ or less. In yet another embodiment, the moment of inertia is about 0.36 oz/in$^2$ or less. Table 2 shows general aerodynamic characteristics for a high spin golf ball having low lift and low drag according to this embodiment of the invention.

TABLE 2

Aerodynamic Characteristics For High Spin Golf Ball

| $N_{Re}$ | ω (rpm) | $C_L$ | $C_D$ | Moment of Inertia |
|---|---|---|---|---|
| 145000 | 3700 | <0.20 | <0.22 | <0.40 oz/in$^2$ |

A golf ball according to either the first or second embodiment may be designed using a unique combination of aerodynamics and construction. A variety of combinations are contemplated by the present invention to achieve the specific relationship between spin rate, lift and drag coefficients, and moment of inertia, which will be discussed in more detail below. One of ordinary skill in the art, however, will appreciate that the examples given below are non-limiting and that there are additional combinations of aerodynamics and construction that will provide a golf ball as intended by the present invention without departing from the scope and spirit of the present invention.

Aerodynamics

Figure 4:
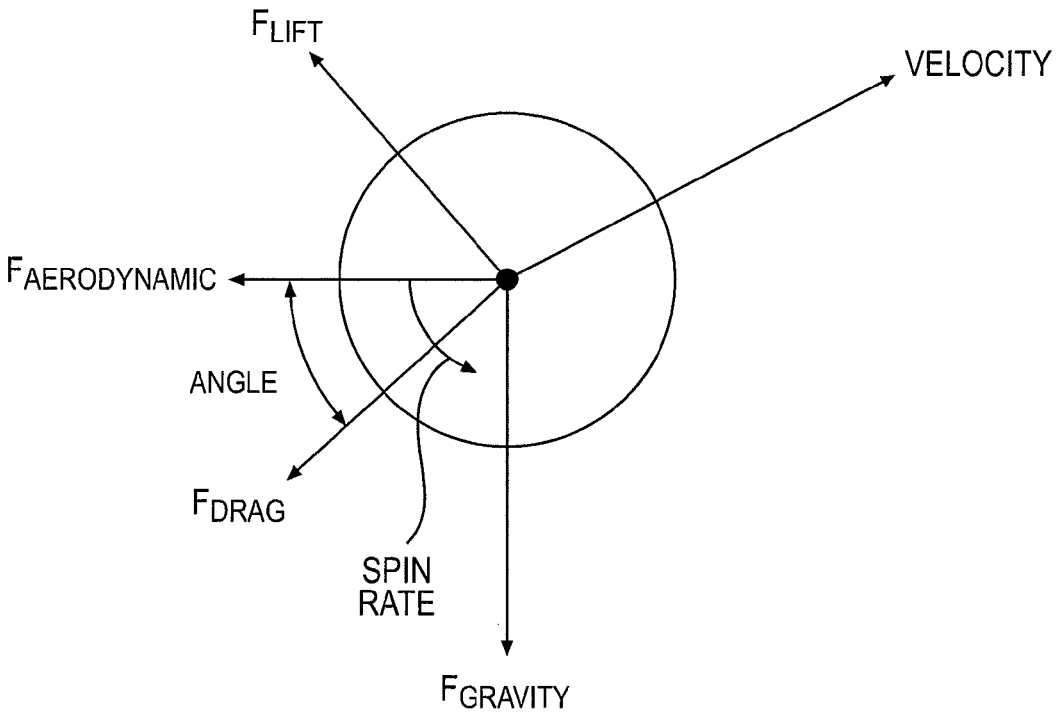
FIG. 4 is an illustration of the forces acting on a golf ball in flight.

The aerodynamic force acting on a golf ball in flight is calculated by Equation 1 and illustrated in FIG. 4:

$$F=F_L+F_D+F_G \quad \text{(Eq. 1)}$$

where

F=force acting on the ball $F_L$=lift force $F_D$=drag force $F_G$=gravity

The lift force ($F_L$) acts in a direction dictated by the cross product of the spin vector and the velocity vector. The drag force ($F_D$) acts in a direction that is directly opposite the velocity vector. The lift and drag forces of Equation 1 are calculated in Equations 2 and 3, respectively:

$$F_L=0.5\ C_L\rho AV^2 \quad \text{(Eq. 2)}$$

$$F_D=0.5\ C_D\rho AV^2 \quad \text{(Eq. 3)}$$

where

ρ=density of air (lb/ft$^3$)

A=projected area of the ball (ft$^2$)((π/4)*$D_p^2$)

V=ball velocity (ft/s)

$C_L$=dimensionless lift coefficient $C_D$=dimensionless drag coefficient

Lift and drag coefficients are used to quantify the force imparted to a ball in flight and are dependent on air density, air viscosity, ball speed, and spin rate. The coefficients may be obtained from Equations 2 and 3 as follow:

$$C_L=2\ F_L/\rho AV^2 \quad \text{(Eq. 4)}$$

$$C_D=2\ F_D/\rho AV^2 \quad \text{(Eq. 5)}$$

Lift and drag coefficients are used to quantify the force imparted to a ball in flight and are dependent on air density, air viscosity, ball speed, and spin rate; the influence of all these parameters may be captured by two dimensionless parameters Spin Ratio (SR) and Reynolds Number ($N_{Re}$). Spin Ratio is the rotational surface speed of the ball divided by ball velocity. Reynolds Number quantifies the ratio of inertial to viscous forces acting on the golf ball moving through air. SR and $N_{Re}$ are calculated in Equations 6 and 7 below:

$$SR=\omega(D/2)/V \quad \text{(Eq. 6)}$$

$$N_{Re}=DV\rho/\mu \quad \text{(Eq. 7)}$$

where

ω=ball rotation rate (radians/s) (2π(RPS))

RPS=ball rotation rate (revolution/s)

V=ball velocity (ft/s)

D=ball diameter (ft)

ρ=air density (slugs/ft$^3$)

μ=absolute viscosity of air (lb/ft-s)

There are a number of suitable methods for determining the lift and drag coefficients for a given range of SR and $N_{Re}$, which include the use of indoor test ranges with ballistic screen technology and is explained in greater detail in U.S. Pat. No. 6,729,976, the entire disclosure of which is incorporated by reference herein. U.S. Pat. No 5,682,230, the entire disclosure of which is incorporated by reference herein, teach the use of a series of ballistic screens to acquire lift and drag coefficients. U.S. Pat. Nos. 6,186,002 and 6,285,445, also incorporated in their entirety by reference herein, disclose methods for determining lift and drag coefficients for a given range of velocities and spin rates using an indoor test range, wherein the values for $C_L$ and $C_D$ are related to SR and $N_{Re}$ for each shot. One skilled in the art of golf ball aerodynamics testing could readily determine the lift and drag coefficients through the use of an indoor test range.

Moment of Inertia

The moment of inertia, as discussed above, also plays an important role in controlling the spin rate of a ball and, ultimately the aerodynamic properties as set forth by the present invention. One of ordinary skill in the art is aware of the methods in obtaining various levels of moment of inertia. A high moment of inertia, for example, may be accomplished by adding more weight to the perimeter of the golf ball, which, in turn, tends to slow the spin rate of a ball due to the higher resistance from the moment of inertia of the ball. Examples of methods of achieving a high moment of inertia are disclosed in U.S. Pat. Nos. 6,902,498 and 6,902,402, the entire disclosures of which are incorporated by reference herein. In contrast, a low moment of inertia, may be found in a golf ball with more weight at the center of the golf ball, which allows for easier rotation of the ball and, thus, an accelerated spin rate as the ball leaves the club. U.S. Patent Publication No. 2005/0059510, the entire disclosure of which is incorporated by reference herein, demonstrates methods of achieving low moments of inertia.

The radial distance, i.e., the centroid radius, from the center of the ball or from the outer cover, where the moment of inertia switches from being increased to being decreased as a result of the redistribution of weight or mass density, is an important factor in golf ball design. When more of the ball's mass or weight is reallocated to the volume of the ball between the center to the centroid radius, the moment of inertia is decreased, thereby producing a high spin ball. When more of the ball's mass or weight is reallocated to the volume between the centroid radius and the outer cover, the moment of inertia is increased, thereby producing a low spin ball. The centroid radius can be determined from Equation 8 and the steps outlined below:

$$R_{centroid}=\sqrt{0.6*r} \quad \text{(Eq. 8)}$$

(a) Setting $r_o$ to half of the 1.68-inch diameter for an average size ball, where $r_o$ is the outer radius of the ball;

(b) Setting the weight of the ball to the USGA legal weight of 1.62 ounces;

(c) Determining the moment of inertia (MOI) of a ball with evenly distributed density prior to any weight distribution, wherein the moment of inertia is represented by Equation 9:

$$MOI=\tfrac{2}{3}M_t r_o^2 \quad \text{(Eq. 9)}$$

where $M_t$=total weight (mass) of ball (ounces)

A 0.4572 oz.-in$^2$ baseline MOI value may be obtained through the MOI formula for a sphere through any diameter as given in the CRC Standard Mathematical Tables, 24$^{th}$ Edition, 1976 at page 20;

(d) Taking a predetermined amount of weight uniformly from the ball and reallocating the weight in the form of a thin shell to a location near the center of the ball and calculating the new MOI of the weight of the redistributed ball;

(e) Comparing the new MOI determined in step (d) to the baseline MOI value determined in step (c) to determine whether the MOI has increased or decreased due to the weight reallocation, i.e., subtracting the baseline MOI from the new MOI;

(f) Repeating steps (d) and (e) with the same predetermined weight incrementally moving away from the center of the ball until the predetermined weight reaches the outer surface of the ball;

(g) Determining the centroid radius as the radial location where the MOI changes from increasing to decreasing; and (h) Repeating steps (d), (e), (f), and (g) with different predetermined weights and confirming that the centroid radius is the same for each predetermined weight.

Examples of various applications of Equations 8 and 9 and steps (a) through (h) are provided in U.S. Pat. Nos. 6,902,498, 6,908,402, and 6,494,795 and U.S. Patent Publication No. 2005/0059510.

Layer hardness and compression may also be adjusted to obtain the desired overall balance of properties. As such, a variety of different constructions may be used to achieve a golf ball according to the present invention. These constructions are discussed in greater detail below.

The specific gravity of the ball cores may be adjusted to obtain the desired moment of inertia. For example, low specific gravity centers, e.g., liquid and foam centers, typically result in high moments of inertia. In one embodiment, the ball may have more than one low specific gravity layers. For example, intermediate layers of the ball may have a specific gravity of less than about 0.9, and more preferably less than about 0.8.

The low specific gravity layer may be made from a number of suitable materials, as long as the layer is durable and does not impart undesirable characteristics to the ball. Suitable materials include, but are not limited to thermosetting syntactic foam with hollow sphere fillers or microspheres in a polymeric matrix of epoxy, urethane, polyester, or any suitable thermosetting binder, where the cured composition has a specific gravity of less than about 0.9. Suitable materials also include polyurethane foam or an integrally skinned polyurethane than forms a solid skin of polyurethane over a foamed substrate of the same composition. Other suitable materials include a nucleated reaction injection moldable (RIM) polyurethane or polyurea, where a gas, e.g., nitrogen, is essentially whipped into at least one component of the polyurethane, usually the prepolymer, prior to component injection into a closed mold where full reaction takes place resulting in a cured polymer having a reduced specific gravity. Moreover, a cast or RIM polyurethane or polyurea may have its specific gravity further reduced by the addition of fillers or hollow spheres. U.S. Pat. Nos. 5,824,746 and 6,025,442 also describe a number of foamed or otherwise specific gravity reduced thermoplastic polymer compositions, e.g., metallocene-catalyzed polymers for use with the present invention, the disclosures of which are incorporated by reference herein. U.S. Pat. Nos. 5,919,100, 6,152,834, and 6,149,535 disclose additional specific gravity reduced materials suitable for incorporation into the present invention golf ball. The disclosures of these patents are incorporated by reference herein. The low specific gravity layer(s) may also be manufactured by casting, spraying, dipping, injection molding, or compression molding.

Dimple Design

Dimple design may aid in the design of a golf ball according to the present invention. One way of designing a golf ball with specific aerodynamic properties, such as those outlined in Tables 1 and 2, is through different dimple patterns and geometry. As used herein, the term "dimple", may include any texturizing on the surface of a golf ball, e.g., depressions and extrusions. Some non-limiting examples of depressions and extrusions include, but are not limited to, spherical depressions, meshes, raised ridges, and brambles. The depressions and extrusions may take a variety of planform shapes, such as circular, polygonal, oval, or irregular. Dimples that have multi-level configurations, i.e., dimple within a dimple, are also contemplated by the invention to obtain desirable aerodynamic characteristics.

Dimple patterns that provide a high percentage of surface coverage are preferred, and are well known in the art, preferably a dimple pattern that provides greater than about 70 percent surface coverage, and even more preferably greater than about 80 percent surface coverage. For example, U.S. Pat. Nos. 5,562,552, 5,575,477, 5,957,787, 5,249,804, and 4,925,193 disclose geometric patterns for positioning dimples on a golf ball. In one embodiment of the present invention, the dimple pattern is at least partially defined by phyllotaxis-based patterns, such as those described U.S. Pat. No. 6,338,684, which is incorporated by reference in its entirety. A tubular lattice pattern, such as the one disclosed in U.S. Pat. No. 6,290,615, which is incorporated by reference in its entirety herein, may also be used with golf balls of the present invention.

Figure 5:
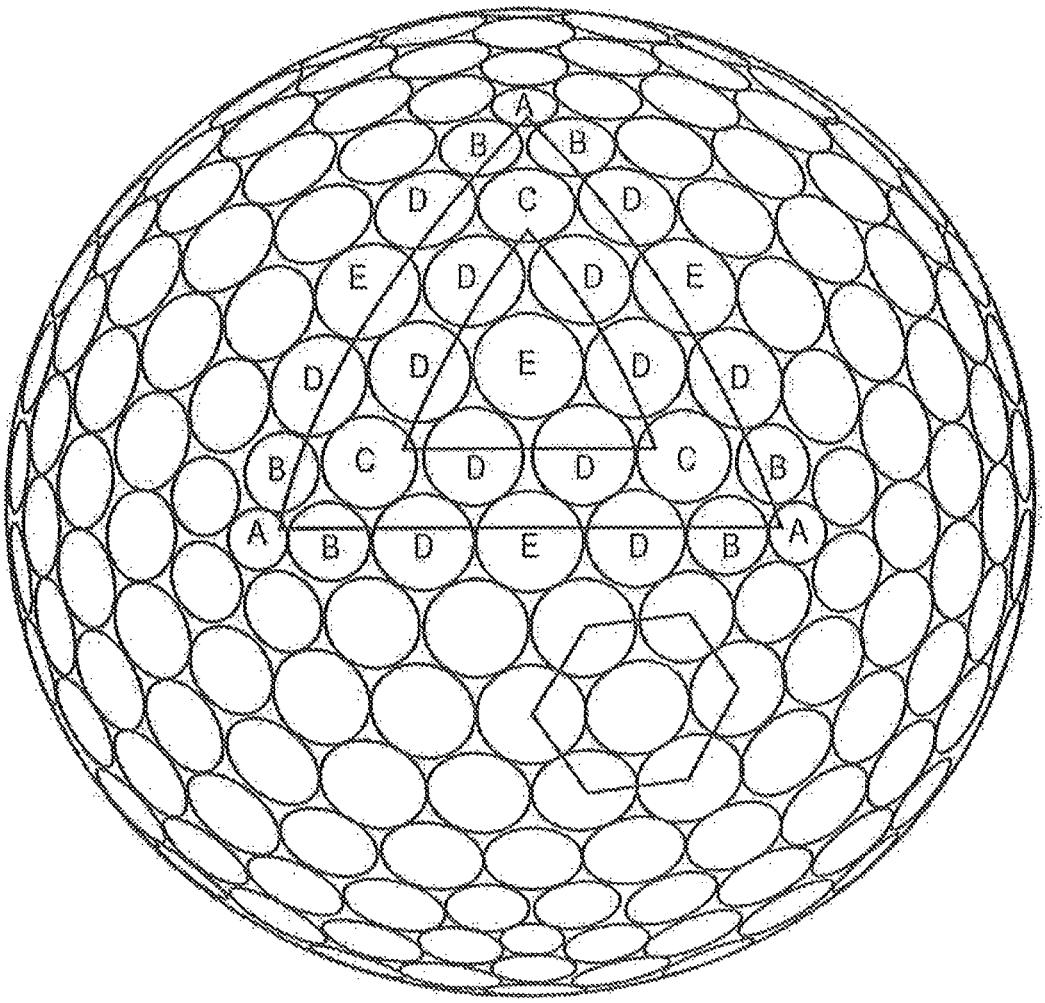
FIG. 5 is an isometric view of an icosahedron dimple pattern to be used in a golf ball according to an embodiment of the present invention.
Figure 6:
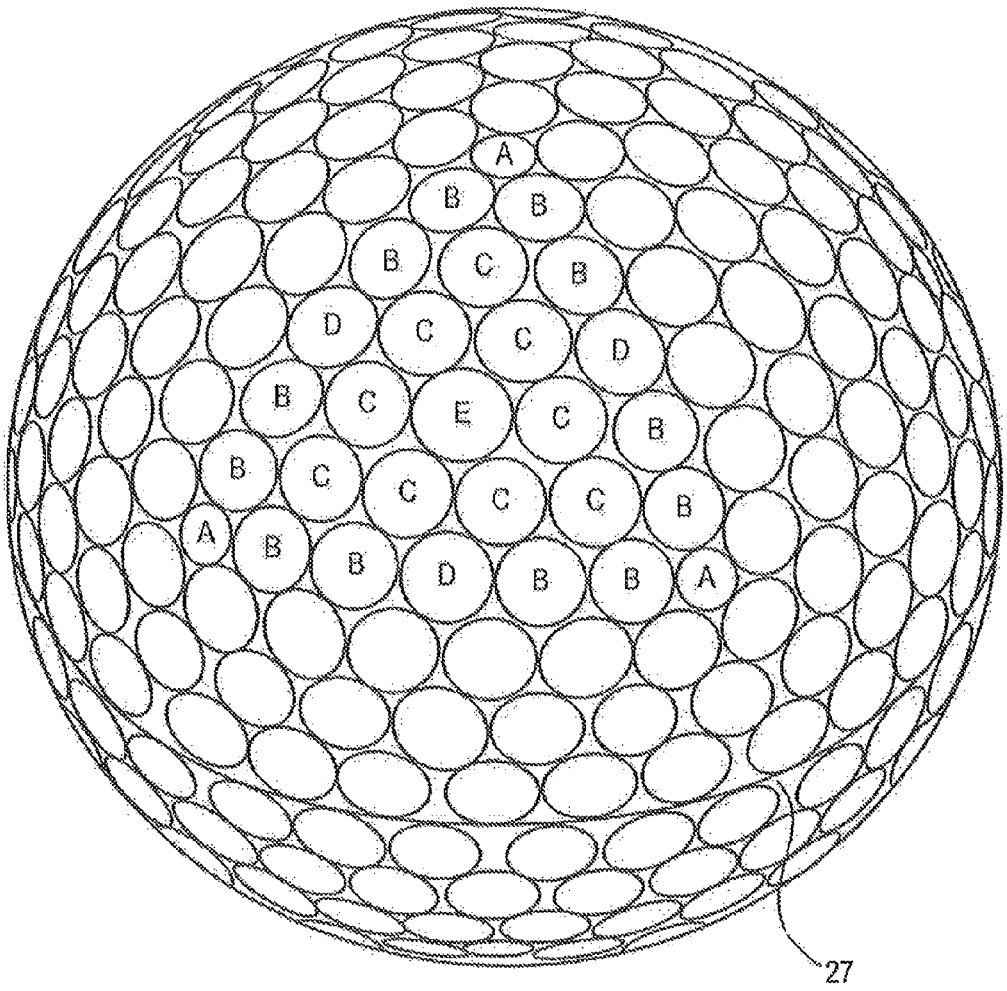
FIG. 6 is an isometric view of an icosahedron dimple pattern to be used in a golf ball according to an embodiment of the present invention.
Figure 7:
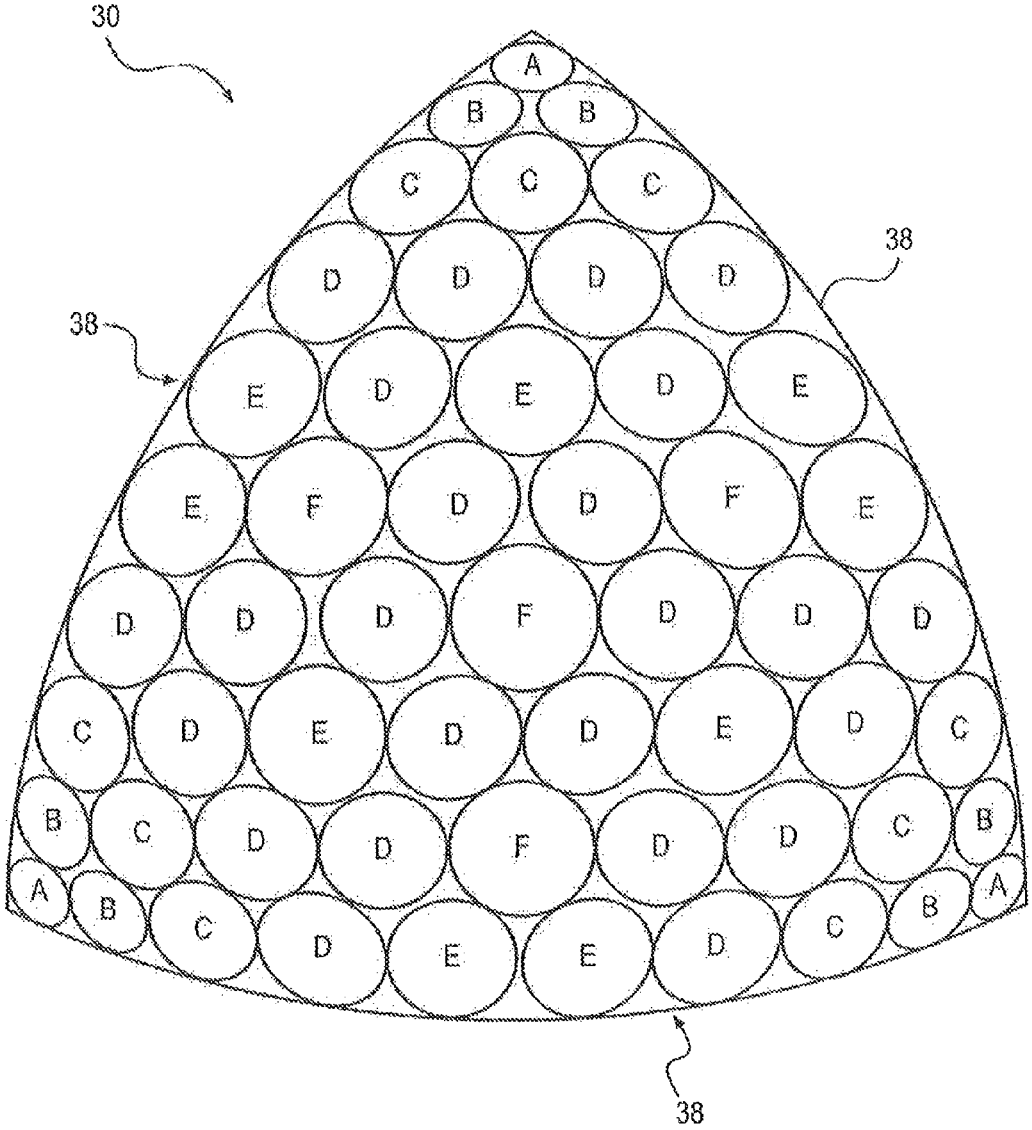
FIG. 7 is a spherical-triangular region of an octahedral dimple pattern to be used in a golf ball according to an embodiment of the present invention.
Figure 8:
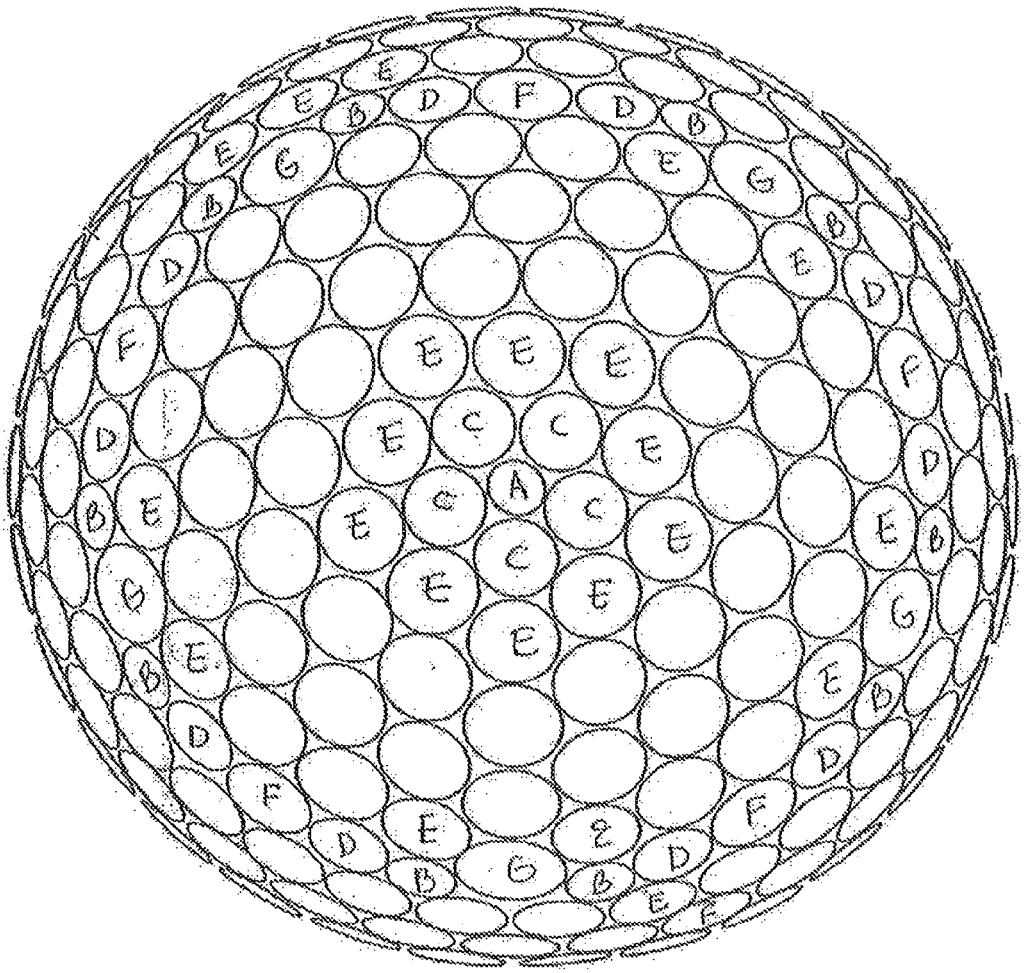
FIG. 8 is a polar view of a golf ball dimple pattern to be used in a golf ball according to an embodiment of the invention.

Several additional non-limiting examples of dimple patterns with varying sizes of dimples are also provided in U.S. patent application Ser. No. 09/404,164 and U.S. Pat. No. 6,213,898, the entire disclosures of which are incorporated by reference herein. In one embodiment, the dimple pattern may include about five different sized dimples, as shown in FIGS. 5-7. For example, FIGS. 5-6 show two different icosahedron dimple patterns on a golf ball 20, wherein there are five different sized dimples A-E, wherein dimples E ($D_E$) are greater than dimples D ($D_D$), which are greater than dimples C ($D_C$), which are greater than dimples B ($D_B$), which are greater than dimples A ($D_A$); $D_E>D_D>D_C>D_B>D_A$. FIG. 7 show an octahedral dimple pattern, wherein there are six different sized dimples A-F, wherein dimples F ($D_F$) are greater than dimples E ($D_E$), which are greater than dimples D ($D_D$), which are greater than dimples C ($D_C$), which are greater than dimples B ($D_B$), which are greater than dimples A ($D_A$); $D_F>D_E>D_D>D_C>D_B>D_A$. FIG. 8 illustrates a dimple pattern with seven different sized dimples, wherein dimples G ($D_G$) are greater than dimples F ($D_F$), dimples F ($D_F$) are greater than dimples E ($D_E$), which are greater than dimples D ($D_D$), which are greater than dimples C ($D_C$), which are greater than dimples B ($D_B$), which are greater than dimples A ($D_A$); $D_G>D_F>D_E>D_D>D_C>D_B>D_A$.

Parting Line

A parting line, or annular region, about the equator of a golf ball has been found to separate the flow profile of the air into two distinct halves while the golf ball is in flight and reduce the aerodynamic force associated with pressure recovery, thus improving flight distance and roll. The parting line must coincide with the axis of ball rotation. It is possible to manufacture a golf ball without parting line, however, most balls have one for ease of manufacturing, e.g., buffing of the golf balls after molding, and many players prefer to have a parting line for putting.

In one embodiment of the present invention, the golf balls include a dimple pattern containing at least one parting line, or annular region. In another embodiment, there is no parting line that does not intersect any dimples, as illustrated in the golf ball shown in FIG. 5. While this increases the percentage of the outer surface that is covered by dimples, the lack of the parting line may make manufacturing more difficult.

In yet another embodiment, the parting line(s) may include regions of no dimples or regions of shallow dimples, such as those disclosed in U.S. Pat. No. 5,566,943, the entire disclosure of which is incorporated by reference herein. For example, most icosahedron patterns generally have modified triangles around the mid-section to create a parting line that does not intersect any dimples. Referring specifically to FIG. 6, the golf ball in this embodiment has a modified icosahedron pattern to create the parting line 27, which is accomplished by inserting an extra row of dimples. Thus, the modified icosahedron pattern in this embodiment has more dimples than the unmodified icosahedron pattern in the embodiment shown in FIG. 5.

In another embodiment, there are more than two parting lines that do not intersect any dimples. For example, the octahedral golf ball shown in FIG. 7 contains three parting lines 38 that do not intersect any dimples. This decreases the percentage of the outer surface dimple coverage as compared with FIG. 5, but eases manufacturing.

In yet another embodiment, the golf balls according to the present invention may have the dimples arranged so that there are less than four parting lines that do not intersect any dimples.

Dimple Count

In one embodiment, the golf balls according to the present invention have about 300 to about 500 total dimples. In another embodiment, the dimple patterns are icosahedron patterns with about 350 to about 450 total dimples. For example, the golf ball of FIGS. 5-6 and 8 have about 362 dimples to about 392 dimples and in the golf ball shown in FIG. 7, there are 440 dimples.

Dimple Diameter

In one embodiment, at least about 80 percent of the dimples have a diameter of about 0.11 inches or greater so that the majority of the dimples are sufficiently large to assist in creating a turbulent boundary layer. In another embodiment, at least about 90 percent of the dimples have a diameter of about 0.11 inches or greater. In yet another embodiment, at least about 95 percent of the dimples have a diameter of about 0.11 inches or greater. For example, all of the dimples have a diameter of about 0.11 inches or greater in the ball illustrated by FIG. 6.

In another embodiment, shown in FIG. 8, about 85 percent of the dimples have a diameter of greater than 0.075 inches and about 5 percent of the dimples have a diameter of about 0.065 inches or less.

Dimple Profile

The profile of the dimple may also aid in the design of a golf ball as outlined by the first embodiment of the invention. For example, golf balls having shallow depth dimples, such as those in U.S. Pat. No. 5,566,943, may be used with golf balls of the present invention to obtain high lift and low drag coefficients. Conversely, a relatively deep dimple depth may aid in obtaining a golf ball with low lift and low drag coefficients.

In addition, dimple patterns wherein all dimples have fixed radii and depth, but vary as to shape, may be useful with the present invention. For example, dimple shape variations may be defined as edge radius and edge angle or by catenary shape factor and edge radius. Dimples defined by the revolution of a catenary curve about an axis, such as the dimple profile disclosed in U.S. Pat. Nos. 6,796,912 and 6,729,976, the entire disclosures of which are incorporated in by reference herein.

Constructions

The selection of materials is also an important factor in achieving a golf ball of the invention. The present invention generally relates to two piece golf balls having a core and a cover, or multilayer golf balls having a solid, liquid, gel, foam, or wound center. In multilayer balls, at least one intermediate layer is disposed concentrically adjacent to the center and a cover. Wound cores have generally been linked to higher spin rates than multilayer solid center balls.

The ratio of cover hardness to core hardness is a primary variable used to control the spin of a ball. In general, the harder the core, the greater the spin and the softer the cover, the greater the spin. For example, a golf ball formed with a soft core and a hard outer cover layer with a high Coefficient of Restitution in addition to the aerodynamics discussed above may aid in achieving a golf ball having a high lift coefficient, a low drag coefficient, low spin, and optionally with a high moment of inertia. In addition, a golf ball formed with a soft core and a soft cover with a high Coefficient of Restitution, e.g., greater than about 0.80, may be useful in obtaining a golf ball according to the second embodiment of the invention, i.e., a low lift coefficient, a low drag coefficient, high spin, and optionally with a low moment of inertia.

Centers

The centers of the golf balls of the present invention preferably have a Shore D hardness of about 65 or less. In another embodiment, the centers preferably have a hardness of about 55 or less. The cores of the invention preferably have reduced compression to help slow the spin rate. In a low spin embodiment, the compression is about 90 points or less. As used herein, the term "points" or "compression points" refer to the standard compression scale based on the ATTI Engineering Compression Tester. In one embodiment, the core compression is about 70 points or less. In contrast, the core compression is preferably about 70 points or more when the desired golf ball has high spin. In this aspect of the invention, the core compression is about 80 points or more.

Conventional materials useful in centers, cores, or core layers of the golf balls of the invention include, but are not limited to, compositions having a base rubber, a cis-to-trans catalyst, a crosslinking agent, a free radical source, and a filler. The base rubber typically includes natural or synthetic rubbers. A preferred base rubber is 1,4-polybutadiene having a cis-structure of at least 40 percent. Natural rubber, polyisoprene rubber and/or styrene-butadiene rubber may be optionally added to the 1,4-polybutadiene. Golf balls of the invention may also have conventional wound cores, where the core comprises a fluid, solid or hollow center wrapped in elastomeric windings.

The free-radical source is typically a peroxide, and preferably an organic peroxide. Suitable free-radical sources include di-t-amyl peroxide, di(2-t-butyl-peroxyisopropyl) benzene peroxide, 1,1-bis(t-butylperoxy)-3,3,5-trimethylcyclohexane, dicumyl peroxide, di-t-butyl peroxide, 2,5-di-(t-butylperoxy)-2,5-dimethyl hexane, n-butyl-4,4-bis(t-butylperoxy)valerate, lauryl peroxide, benzoyl peroxide, t-butyl hydroperoxide, and the like, and any mixture thereof.

Suitable crosslinking agents include one or more metallic salts of unsaturated α, β-fatty acids or monocarboxylic acids, such as zinc, calcium, or magnesium acrylate salts, and the like, and mixtures thereof. Preferred acrylates include zinc acrylate, zinc diacrylate, zinc methacrylate, and zinc dimethacrylate, and mixtures thereof The crosslinking agent must be present in an amount sufficient to crosslink a portion of the chains of polymers in the resilient polymer component. For example, the desired compression may be obtained by altering the type and amount of crosslinking agent. Crosslinkers may be included in other layers of the ball to increase the hardness of reaction products used.

Fillers may be used to modify the distribution of ball weight to or from the perimeter or center of the ball. Fillers typically include processing aids or compounds to affect rheological and mixing properties, the specific gravity (i.e., density-modifying fillers), the modulus, the tear strength, reinforcement, and the like. The fillers are generally inorganic, and suitable fillers include numerous metals or metal oxides, such as zinc oxide and tin oxide, as well as barium sulfate, zinc sulfate, calcium carbonate, barium carbonate, clay, tungsten, tungsten carbide, an array of silicas, ground particles of cured rubber, and mixtures thereof. Fillers may also include various foaming agents or blowing agents that may be readily selected by one of ordinary skill in the art. Foamed polymer blends may be formed by blending blowing agent(s) with polymer material, as is well known by those of ordinary skill in the art. Polymeric, ceramic, metal, or glass microspheres, or combinations thereof, may be used to adjust the density or other properties of a given layer, and such microspheres may be solid or hollow, and filled or unfilled. Fillers are typically also added to one or more portions of the golf ball to modify the density thereof to conform to uniform golf ball standards.

In balls with liquid centers, a mixture of corn syrup, salt, and water may be used. Corn syrup and salt are added to increase the specific gravity and viscosity. In another embodiment, water may used as the liquid. In yet another embodiment, a barium sulfate paste may be employed.

In one embodiment, the center of the golf ball is formed from a polybutadiene composition including tungsten filler with a surrounding layer of a foamed, resilient thermoplastic elastomer, such as a partially or fully neutralized ionomer.

Hard Covers

In the first embodiment of the present invention, to achieve a golf ball with a high lift coefficient, low drag coefficient, and low spin, the cover hardness is preferably about 60 Shore D or greater. In one embodiment, the cover hardness is about 65 Shore D or greater. More preferably, the hardness of the cover is about 61 Shore D to about 67 Shore D.

In one embodiment, the cover has a flexural modulus of between about 60,000 psi and about 70,000 psi. A high flexural modulus may aid in lowering the spin rate, as well as providing increased initial velocity, which may be a benefit to a low swing-speed player.

A wide variety of cover materials may be used to design a golf ball having a low spin rate, high lift coefficient, and low drag coefficient according to the first embodiment of the present invention. In one embodiment, the cover is formed from ionomer resins. Blends of ionomers, including acid-containing olefin copolymer ionomers, may also be used to form the cover for the first embodiment of the invention. These ionomers are copolymers of an olefin such as ethylene and an α, β-unsaturated carboxylic acid such as acrylic or methacrylic acid present in about 5 to about 35 weight percent of the polymer, preferably about 10 to about 35 weight percent of the polymer, and more preferably about 15 to about 20 weight percent of the polymer, wherein the acid moiety is neutralized from about 1 percent to about 100 percent, preferably at least about 40 percent, and more preferably at least about 60 percent, to form an ionomer by a cation such as lithium, sodium, potassium, magnesium, calcium, barium, lead, tin, zinc or aluminum, or a combination of such cations, of which lithium, sodium and zinc are preferred. Specific acid-containing ethylene copolymers include ethylene/acrylic acid, ethylene/methacrylic acid, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. In one embodiment, the acid-containing ethylene copolymers include ethylene/methacrylic acid, ethylene/acrylic acid, ethylene/methacrylic acid/n-butyl acrylate, ethylene/acrylic acid/n-butyl acrylate, ethylene/methacrylic acid/methyl acrylate and ethylene/acrylic acid/methyl acrylate copolymers. In a preferred embodiment, the acid-containing ethylene copolymers are ethylene/methacrylic acid, ethylene/acrylic acid, ethylene/(meth)acrylic acid/n-butyl acrylate, ethylene/(meth)acrylic acid/ethyl acrylate, and ethylene/(meth) acrylic acid/ethyl acrylate ad. ethylene/(meth) acrylic acid/methyl acrylate copolymers.

The manner in which these ionomers resins are made is well known in the art, such as through the process described in U.S. Pat. No. 3,262,272, the entire disclosure of which is incorporated by reference herein. A non-limiting example of a suitable blend for a hard cover is a composition including ionomer resins that are copolymers of about 80 percent to about 95 percent of an olefin, e.g., ethylene, and about 13 percent to about 16 percent by weight of an α, β-unsaturated carboxylic acid, wherein about 10 percent to about 90 percent of the carboxylic acid groups are neutralized with a metal ion. In one embodiment, a first ionomer is neutralized with lithium and a second ionomer is neutralized with sodium. In another embodiment, the blend comprises between about 10 percent and about 65 percent of the lithium ionomer and between about 90 percent and about 45 percent of the sodium ionomer. In another embodiment, the blend is a 50/50 blend. Examples of commercially available ionomers include SURLYN® 8140, which is a sodium ionomer, SURLYN® 9910, which is a zinc ionomer, and SURLYN® 7940, which is a standard lithium ionomer.

Soft Covers

In the second embodiment of the invention, a golf ball having a low lift coefficient, a low drag coefficient, and high spin, preferably has a soft cover. The cover in this embodiment is about 60 Shore D or less, preferably about 55 Shore D or less, and more preferably about 45 Shore to about 55 Shore D. Suitable materials for a soft cover layer include, but are not limited to, balata, very low modulus ionomers, and blends thereof. In one embodiment, the materials for a soft cover layer include those with a flexural modulus of about 65,000 psi or less. Other non-limiting examples of materials for use with a soft cover layer include those disclosed in U.S. Pat. Nos. 5,298,571, 5,120, 791, 5,068, 151, 5,000,549, 3,819,768, 4,264,075, 4,526,375, 4,911, 451, 5,197,740, and 3,264,272.

Additional components that can be added to the golf ball compositions of the present invention include, but are not limited to, UV stabilizers; light stabilizers; antioxidants; dyes; optical brighteners; white, colored and/or fluorescent pigments; violet agents; softening agents; waxes; surfactants; processing aids; plasticizers, including internal and external plasticizers; impact modifiers; toughening agents; reinforcing materials and metallic powders, such as titanium, tungsten and copper powders. All of these materials, which are well known in the art, are added for their usual purpose in typical amounts, as is well known to the person of ordinary skill in the art.

While the above invention has been described with reference to certain preferred embodiments, it should be kept in mind that the scope of the present invention is not limited to just these embodiments. One skilled in the art would recognize numerous variations of the embodiments described herein without departing from the spirit and scope of the invention. In addition, features of one embodiment can be combined with features of another embodiment. One skilled in the art may find other variations of the preferred embodiments which, nevertheless, fall within the spirit of the present invention, whose scope is defined by the claims set forth below.

What is claimed is:

1. A golf ball comprising a core and cover, wherein the golf ball comprises a moment of inertia of about 0.40 oz/in$^2$ or less, the lift coefficient is less than about 0.20, and the drag coefficient is less than about 0.22 at a Reynolds Number of about 145000 and a spin rate of about 3700 rpm, wherein the cover has a hardness of about 60 Shore D or less, wherein the core has an atti compression of about 80 or more and a Shore D hardness of about 65 or less, and wherein the golf ball has a coefficient of restitution of greater than about 0.80.

2. The golf ball of claim 1, wherein the cover has a hardness of about 50 Shore D or less.

3. The golf ball of claim 1, wherein the cover has a hardness of about 45 Shore D to about 55 Shore D.

4. The golf ball of claim 1, wherein the cover comprises an inner cover layer and an outer cover layer.

5. The golf ball of claim 4, wherein the inner cover layer has a first hardness and the outer cover layer has a second hardness less than the first hardness.

6. The golf ball of claim 5, wherein the first hardness is about 60 Shore D or greater and the second hardness is less than about 60 Shore D.

7. The golf ball of claim 1, wherein the core has a hardness of about 55 Shore D or less.

8. The golf ball of claim 1, wherein the core comprises polybutadiene and tungsten.

9. The golf ball of claim 8, wherein the cover comprises an inner cover and an outer cover, and wherein the inner cover comprises a partially or fully neutralized ionomer.

10. A golf ball comprising a core and cover, wherein the golf ball comprises a moment of inertia of about 0.38 oz/in$^2$ or less, the lift coefficient is less than about 0.20, and the drag coefficient is less than about 0.22 at a Reynolds Number of about 145000 and a spin rate of about 3700 rpm, and a coefficient of restitution of greater than 0.80, wherein the core has an atti compression of about 80 or more and a hardness of about 55 Shore D or less, and wherein the cover has a hardness of about 60 Shore D or less.

11. The golf ball of claim 10, wherein the cover has a hardness of about 55 Shore D or less.

12. The golf ball of claim 10, wherein the cover comprises an inner cover layer and an outer cover layer.

13. The golf ball of claim 10, wherein the inner cover layer has a first hardness and the outer cover layer has a second hardness less than the first hardness.

14. The golf ball of claim 13, wherein the first hardness is about 60 Shore D or greater and the second hardness is less than about 60 Shore D.

15. The golf ball of claim 10, wherein the moment of inertia is about 0.36 oz/in$^2$ or less.

16. The golf ball of claim 10, wherein the cover has a hardness of about 45 Shore D to about 55 Shore D.

17. The golf ball of claim 10, wherein the core comprises polybutadiene and tungsten.

18. The golf ball of claim 10, wherein the cover comprises an inner cover and an outer cover, and wherein the inner cover comprises a partially or fully neutralized ionomer.

19. A golf ball comprising a core and cover, wherein the cover comprises an inner cover layer and an outer cover layer, wherein the golf ball comprises a moment of inertia of about 0.40 oz/in$^2$ or less, the lift coefficient is less than about 0.20, and the drag coefficient is less than about 0.22 at a Reynolds Number of about 145000 and a spin rate of about 3700 rpm, wherein the outer cover has a flexural modulus of about 65,000 psi or less, wherein the inner cover layer has a hardness greater than the outer cover layer, wherein the core has an atti compression of about 80 or more and a Shore D hardness of about 65 or less, and wherein the golf ball has a coefficient of restitution of greater than about 0.80.

20. The golf ball of claim 19, wherein the inner cover layer has a hardness of about 60 Shore D or greater.

* * * * *